US011739281B2

(12) United States Patent
Bouvier et al.

(10) Patent No.: US 11,739,281 B2
(45) Date of Patent: Aug. 29, 2023

(54) USE OF A LUBRICANT COMPOSITION FOR TRANSMISSION

(71) Applicant: TOTAL MARKETING SERVICES, Puteaux (FR)

(72) Inventors: Goulven Bouvier, Lyons (FR); Nicolas Champagne, Caluire et Cuire (FR); Gael Robineau, Lyons (FR)

(73) Assignee: TOTALENERGIES ONETECH, Courbevoie (FR)

( * ) Notice: Subject to any disclaimer, the term of this patent is extended or adjusted under 35 U.S.C. 154(b) by 0 days.

(21) Appl. No.: 17/600,426

(22) PCT Filed: Mar. 27, 2020

(86) PCT No.: PCT/EP2020/058788
§ 371 (c)(1),
(2) Date: Sep. 30, 2021

(87) PCT Pub. No.: WO2020/201126
PCT Pub. Date: Oct. 8, 2020

(65) Prior Publication Data

US 2022/0145205 A1 May 12, 2022

(30) Foreign Application Priority Data

Apr. 1, 2019 (FR) ..... 19 03441

(51) Int. Cl.

| | |
|---|---|
| ***C10M 129/70*** | (2006.01) |
| ***C10M 169/04*** | (2006.01) |
| *C10N 30/00* | (2006.01) |
| *C10N 40/04* | (2006.01) |

(52) U.S. Cl.
CPC ..... *C10M 129/70* (2013.01); *C10M 169/04* (2013.01); *C10M 2207/281* (2013.01); *C10N 2030/54* (2020.05); *C10N 2040/04* (2013.01)

(58) Field of Classification Search
CPC ..... C10M 129/70; C10M 169/04; C10M 2207/281; C10M 2203/1025; C10M 2205/024; C10M 2207/2815; C10M 2209/084; C10M 105/34; C10N 2030/54; C10N 2040/04; C10N 2020/011; C10N 2020/02; C10N 2020/069; C10N 2020/071; C10N 2030/02; C10N 2030/06; C10N 2040/044; C10N 2040/046
USPC ..... 508/463
See application file for complete search history.

(56) References Cited

U.S. PATENT DOCUMENTS

| | | | |
|---|---|---|---|
| 2,050,788 A | 8/1936 | Fuchs et al. | |
| 4,518,810 A | 5/1985 | Matsuda et al. | |
| 8,664,169 B2 | 3/2014 | Bouffet | |
| 2016/0319215 A1 | 11/2016 | Hirooka et al. | |
| 2017/0145337 A1 | 5/2017 | Masuda et al. | |
| 2017/0183595 A1* | 6/2017 | Ng | C07C 69/708 |
| 2019/0062663 A1 | 2/2019 | Patil et al. | |

FOREIGN PATENT DOCUMENTS

| | | |
|---|---|---|
| JP | 2002-146374 A | 5/2002 |
| WO | 2010/038147 A1 | 4/2010 |
| WO | 2015/099907 A1 | 7/2015 |

OTHER PUBLICATIONS

International Search Report and Written Opinion for counterpart Application No. PCT/EP2020/058788, dated Jun. 9, 2020.

* cited by examiner

*Primary Examiner* — Prem C Singh
*Assistant Examiner* — Francis C Campanell
(74) *Attorney, Agent, or Firm* — The Marbury Law Group, PLLC

(57) ABSTRACT

The present invention relates to the use of a lubricating composition comprising: —at least one base oil; and—at least one monoester which is separate from the base oil and formed between a linear, saturated or unsaturated $C_8$-$C_{14}$ monocarboxylic acid, and a branched, saturated or unsaturated $C_4$-$C_{16}$ monoalcohol to reduce the fuel consumption of a vehicle fitted with a transmission member, in particular a gearbox and/or an axle, which is lubricated by means of said composition.

16 Claims, No Drawings

USE OF A LUBRICANT COMPOSITION FOR TRANSMISSION

CROSS REFERENCE TO RELATED APPLICATION

This is a national stage application of PCT/EP2020/058788, filed internationally on Mar. 27, 2020, which claims priority to French Application No. 19 03441, filed on Apr. 1, 2019, which are incorporated by reference herein in their entireties.

TECHNICAL FIELD

The present invention relates to the field of lubricating compositions, more particularly the field of lubricating compositions for motor vehicle transmissions, for example gearboxes or axles. It relates more particularly to the use of novel compounds of monoester type in lubricating compositions for transmissions for the purpose of improving the fuel economy properties thereof, that is to say their ability to limit the fuel consumption of the motor vehicles without affecting their performance qualities, in particular in terms of cold properties.

PRIOR ART

Lubricating compositions, also known as "lubricants", are commonly employed in various systems of motor vehicles for the main purposes of reducing friction forces between the different metallic moving parts within these systems, in particular the engine, the transmission and the hydraulic circuit. They are also effective for preventing premature wear of or even damage to these parts, and in particular their surface. To achieve this, a lubricating composition is conventionally composed of a base oil which is generally combined with a number of additives dedicated to boosting the lubricating performance qualities of the base oil, such as for example friction-modifying additives, but also to providing additional performance qualities.

Lubricating compositions for transmissions (for example gearboxes or axles) must meet numerous requirements, in particular with regard to the strict specifications imposed by the automobile manufacturers. In particular, they must possess satisfactory properties in terms of viscosity, viscosity-temperature behavior, cold performance, etc. suitable for their use in a transmission component, in particular in the gearbox or the axles, in a vehicle.

For example, automobile manufacturer specifications systematically impose, for transmission oils of certain vehicles, a specific kinematic viscosity of 100° C. (or KV100) measured in accordance with the standard ASTM D445, generally of between 5 and 15 $mm^2/s$. Such a limitation is linked to mechanical design considerations of the gearboxes, bearings and gears. Likewise, lubricants for transmissions must have good performance qualities in terms of cold properties and a good viscosity-temperature behavior in order to guarantee perfect operation with a hot engine and a cold engine, or else good compatibility with the elastomers generally used in transmission seals so that the latter do not swell, do not shrink and do not become brittle.

On the other hand, current environmental concerns, in particular with the aim of reducing carbon dioxide emissions, result in an urgent need to reduce the fuel consumption of motor vehicles. In this respect, it is known that the lubricating compositions constitute an effective way to act on fuel consumption via their impact on the friction forces generated between the different systems of motor vehicles. There is therefore a need to develop lubricants that make it possible to reduce friction in gearboxes and in axle differentials.

The formulation of oils for transmissions, enabling a gain in fuel economy, preferentially makes use of lubricating bases having a very high viscosity index (VI). The viscosity index, measured in accordance with the standard ASTM D2270, quantifies the ability of the lubricant to exhibit low variations in viscosity as a function of the temperature, based on measurements according to ASTM D445 of the kinematic viscosities at 40° C. (KV40) and 100° C. (KV100). It has thus been proposed to use long-chain fatty acid esters having a very high viscosity index combined with a low viscosity.

The use of these fatty acid esters can, however, have a negative impact on the other properties required for transmission lubricants, and can in particular prove to be detrimental to their cold performance qualities.

Consequently, improving the fuel economy properties of lubricants for transmissions, while at the same time also maintaining the high levels of performance required, remains a challenge.

As examples of lubricants for transmissions, mention may be made of the document WO 2010/038147, which proposes, for generating fuel savings, formulating lubricating compositions for gearboxes, using at least 30% by weight of one or more methyl esters of fatty acids of the formula $RCOOCH_3$, where R is a paraffinic or olefinic group containing from 11 to 23 carbon atoms, in combination with one or more phosphorus-based, sulfur-based or phospho-sulfur-based extreme pressure and/or antiwear additives and polyalphaolefins.

Mention may also be made of the document US 2017/0145337, which describes lubricating compositions for transmissions exhibiting a gain in fuel economy, based on a base oil having a kinematic viscosity at 100° C. ranging from 1.5 $mm^2/s$ to 3.5 $mm^2/s$, and comprising from 3% to 10% of an oil of monoester type with a kinematic viscosity at 100° C. ranging from 2 $mm^2/s$ to 10 $mm^2/s$, and also an ester of phosphite type which provides sulfur.

SUMMARY OF THE INVENTION

The present invention aims to provide a novel lubricating composition which has improved properties in terms of fuel saving (fuel economy properties) while at the same time satisfying the properties required for the use of said composition for the lubrication of transmission components of light or heavy motor vehicles, for example gearbox and axles, and in particular having good performance qualities in terms of cold properties.

The present invention therefore describes a lubricating composition for motor vehicle transmissions comprising:

- at least one base oil; and
- at least one monoester, different from said base oil, formed between a linear, saturated or unsaturated, $C_8$-$C_{14}$, preferably $C_{10}$-$C_{14}$ and more preferentially $C_{10}$-$C_{13}$, monocarboxylic acid and a branched, saturated or unsaturated, $C_4$-$C_{16}$, in particular $C_6$-$C_{12}$, monoalcohol.

In particular, the present invention relates, according to a first of its aspects, to the use of a lubricating composition comprising:

- at least one base oil; and
- at least one monoester, different from said base oil, formed between a linear, saturated or unsaturated, $C_8$-$C_{14}$ monocarboxylic acid and a branched, saturated or unsaturated, $C_4$-$C_{16}$ monoalcohol, to reduce the fuel consumption of a vehicle equipped with a transmission component, in particular a gearbox and/or an axle, lubricated by means of this composition.

In the remainder of the text, and unless indicated otherwise, the term "monoester of the invention" will denote that satisfying the abovementioned definition.

Preferably, a monoester according to the invention is formed between a linear saturated $C_8$-$C_{14}$, preferably $C_{10}$-$C_{14}$ and more preferentially $C_{10}$-$C_{13}$, monocarboxylic acid and a branched saturated $C_4$-$C_{16}$, in particular $C_6$-$C_{12}$, monoalcohol.

Advantageously, a monoester according to the invention can be 2-ethylhexyl dodecanoate. As will become apparent from the following examples, the inventors have found that the use of a monoester according to the invention makes it possible to obtain a lubricating composition which has both improved properties in terms of fuel economy and satisfactory performance qualities, in particular in terms of cold properties, essential for its use as transmission lubricant.

In particular, a lubricating composition according to the invention, comprising at least one monoester as defined above, advantageously combines good properties in terms of fuel economy and good cold performance qualities.

The performance qualities in terms of fuel economy can advantageously be evaluated by means of measuring the coefficient of traction. This coefficient of traction, denoted COT, can be measured using an MTM tribometer, for example under the conditions detailed in the examples.

Advantageously, a composition according to the invention meets the specifications required for transmission lubricants and in particular retains good performance qualities in terms of cold properties. The cold properties can be evaluated by Brookfield measurement at −40° C. in accordance with the standard ASTM D2983. Preferably, a lubricating composition according to the invention has a Brookfield viscosity, measured at −40° C. in accordance with the standard ASTM D2983, of between 1000 mPa·s and 100,000 mPa·s, preferably of between 5000 mPa·s and 60,000 mPa·s.

Likewise, as detailed in the remainder of the text, a lubricating composition according to the invention satisfies the viscosities required for an application for lubricating transmissions, and a good stability of the viscosity with temperature, in other words a good viscosity index. Lastly, the monoesters according to the invention advantageously have good compatibility with elastomers, such as those commonly used in transmission seals, which allows them to be used at high contents in lubricants for transmissions. In particular, the monoester or mixture of monoesters according to the invention may be used in a lubricant for transmissions in an amount of 5% to 40% by weight, in particular 10% to 30% by weight, and particularly 15% to 30% by weight, relative to the total weight of the lubricant for transmissions.

Advantageously, a lubricating composition for transmissions according to the invention comprises less than 30% by weight of monoester(s), in particular from 1% to 30% by weight of monoester(s).

A content of less than 30% by weight of monoester(s) makes it possible to ensure good compatibility of the lubricating composition with the elastomers employed in transmission components, in particular used for transmission seals.

This compatibility results in an absence of physical or chemical alteration of the elastomers, thus advantageously making it possible to maintain the coefficients of traction at satisfactory levels.

A lubricating composition according to the invention is particularly useful for lubricating transmission components of motor vehicles, in particular for light or heavy vehicles, for example gearboxes, axles, preferably manual gearbox and heavy-duty axles.

Thus, the present invention also describes the use of a lubricating composition according to the invention for lubricating the transmission components of motor vehicles, in particular transmissions for light or heavy vehicles, for example gearboxes, axles, preferably manual gearbox and heavy-duty axles.

The present invention likewise describes a method for lubricating at least one mechanical part of a motor vehicle transmission component, in particular of light or heavy vehicles, for example gearbox, axles, preferably manual gearbox and heavy-duty axles, said method comprising at least one step in which said mechanical part is brought into contact with at least one lubricating composition according to the invention.

It also describes the use of a monoester according to the invention, as defined above, for reducing the coefficient of traction of a lubricating composition for transmission in a motor vehicle, in particular of a gearbox lubricant and/or of an axle lubricant, in particular for heavy duty-axles.

Other characteristics, variants and advantages of the use of a monoester according to the invention in a transmission oil will become more clearly apparent on reading the description and examples which follow and are given by way of illustration and do not limit the invention.

In the remainder of the text, the expressions "between . . . and . . . ", "ranging from . . . to . . . " and "varying from . . . to . . . " are equivalent and are intended to mean that the limits are included, unless otherwise stated.

Unless otherwise indicated, the expression "comprising a" should be understood as "comprising at least one".

DETAILED DESCRIPTION

Monoester

As specified above, a lubricating composition for transmissions comprises at least one monoester formed between a linear, saturated or unsaturated, preferably saturated, $C_8$ to $C_{14}$ monocarboxylic acid and a branched, saturated or unsaturated, $C_4$ to $C_{16}$ monoalcohol.

Advantageously, a monoester of the invention has a kinematic viscosity, measured at 100° C. in accordance with the standard ASTM D445, ranging from 1.0 $mm^2/s$ to 2.5 $mm^2/s$, preferably from 1.3 $mm^2/s$ to 2.3 $mm^2/s$.

Advantageously, a monoester of the invention also has good cold properties, in particular a low pour point. A monoester of the invention preferentially has a pour point, measured in accordance with the standard ISO 3106, of less than or equal to 0° C., preferably of less than or equal to −10° C.

Advantageously, a monoester according to the invention has a low coefficient of traction. The coefficient of traction is determined by an MTM machine (Mini Traction Machine) sold by PCS instrument.

In the context of the invention, the term "monocarboxylic acid" is understood to denote a compound formed of a hydrocarbon-based chain of alkyl or alkenyl type bearing a carboxylic acid function at one of its ends.

In the context of the invention, the term "$C_8$ to $C_{14}$ monocarboxylic acid" is understood to denote a monocarboxylic acid the alkyl- or alkenyl-type hydrocarbon-based chain of which comprises from 8 to 14 carbon atoms.

The term "linear" is used to describe a monocarboxylic acid the alkyl or alkenyl chain of which is linear, as opposed to a branched chain.

The term "saturated" is used to describe a carboxylic acid the hydrocarbon-based chain of which is a saturated chain of alkyl type, as opposed to an unsaturated chain of alkenyl type. Preferably, the monoester according to the invention is obtained from a linear saturated monocarboxylic acid, in particular comprising from 10 to 14 carbon atoms, preferably from 11 to 13 carbon atoms. In one particular embodiment, a monoester according to the invention is obtained from dodecanoic acid ($C_{12}$).

Such acids may be commercially available or prepared according to synthesis methods known to those skilled in the art.

The alcohol from which a monoester according to the invention is formed is a branched, saturated or unsaturated, monoalcohol.

The term "monoalcohol" is intended to denote a compound formed of a hydrocarbon-based chain of alkyl or alkenyl type, bearing a hydroxyl function at one of its ends.

The term "$C_4$ to $C_{16}$ monoalcohol" is understood to denote a monoalcohol the alkyl- or alkenyl-type hydrocarbon-based chain of which has 4 to 16 carbon atoms.

The term "branched" is used to describe a monoalcohol the alkyl or alkenyl chain of which is branched, as opposed to a linear chain.

The term "saturated" is used to describe a monoalcohol the hydrocarbon-based chain of which is a chain of alkyl type, as opposed to an unsaturated chain of alkenyl type.

The branched, preferably saturated, chain of a monoalcohol according to the invention may particularly comprise from 4 to 16 carbon atoms, in particular from 6 to 12 carbon atoms and more particularly from 7 to 10 carbon atoms.

Preferably, it can be formed of a linear main chain, preferably a linear alkyl chain, having from 3 to 14 carbon atoms, in particular from 4 to 10 carbon atoms, said main chain having at least one pendant alkyl group, in particular one to three pendant alkyl groups, said pendant alkyl groups being more particularly $C_1$ to $C_4$, preferably $C_1$ to $C_3$, pendant alkyl groups, in particular the pendant alkyl groups being methyl and/or ethyl groups.

The term "main chain of a monoalcohol" is used to describe the hydrocarbon-based chain comprising the longest succession of carbon atoms having a hydroxyl function at the end of the chain.

According to one embodiment, the monoalcohol has a linear alkyl main chain having from 3 to 14 carbon atoms and one to three pendant alkyl groups having 1 to 4 carbon atoms, preferably the monoalcohol has a linear main alkyl chain having from 4 to 10 carbon atoms and a pendant alkyl group having from 1 to 3 carbon atoms.

A monoester according to the invention can for example be obtained from 2-ethylhexanol or from 3,5,5-trimethylhexanol, advantageously from 2-ethylhexanol.

Such alcohols may be commercially available or prepared according to synthesis methods known to those skilled in the art. In particular, these branched alcohols can be obtained from light alcohols, that is to say comprising between 1 and 4 carbon atoms, more particularly comprising 1 or 2 carbon atoms, by a synthesis known in the literature under the name "Guerbet reaction". Guerbet syntheses have typically been used to prepare higher molecular weight branched-chain alcohols from lower molecular weight starting materials. Examples of Guerbet synthesis are described in particular in documents U.S. Pat. Nos. 4,518,810 and 2,050,788.

It is understood that the definitions given above for the monocarboxylic acid and for the monoalcohol can be combined, as far as possible, to define particular monoesters suitable for the invention.

In other words, a monoester according to the invention can more particularly correspond to the following formula (I):

$$R^1—C(O)—O—R^2$$ [Chemical formula 1]

in which:

$R^1$ represents a linear alkyl or alkenyl chain, preferably a linear $C_7$ to $C_{13}$, in particular $C_9$ to $C_{13}$ and more particularly $C_9$ to $C_{12}$, for example $C_{11}$, alkyl chain;

$R^2$ represents a branched alkyl or alkenyl chain, preferably a branched $C_4$ to $C_{16}$, in particular $C_6$ to $C_{12}$ and more particularly $C_7$ to $C_{10}$, alkyl chain.

As described above, $R^2$ is preferably formed of a main linear, in particular $C_3$-$C_{14}$, alkyl chain having at least one pendant alkyl group, preferably one, two or three pendant alkyl groups, said alkyl groups being more particularly $C_1$ to $C_4$, preferably $C_1$ to $C_3$, alkyl groups, in particular methyl and/or ethyl groups.

Advantageously, $R^2$ represents a 2-ethylhexyl or 3,5,5-trimethylhexyl group, advantageously 2-ethylhexyl.

Advantageously, a monoester used according to the invention is chosen from the monoesters obtained from the linear $C_{12}$ acid (dodecanoic acid) and 2-ethylhexanol or 3,5,5-trimethylhexanol, and mixtures thereof. It may in particular be 2-ethylhexyl dodecanoate.

According to one embodiment, the monoester according to the invention does not contain heteroatoms other than those forming the ester function of the monoester.

The monoesters according to the invention may be commercially available or prepared according to synthesis methods known to those skilled in the art. These synthesis methods more particularly carry out an esterification reaction between a monoalcohol and a monocarboxylic acid.

Of course, it is up to those skilled in the art to adjust the synthesis conditions in order to obtain a monoester according to the invention.

It is understood that, in the context of the present invention, a monoester according to the invention can be in the form of a mixture of at least two monoesters according to the invention, as defined above.

Likewise, a lubricating composition for transmission according to the invention may optionally comprise, in addition to one or more monoesters in accordance with the invention, one or more monoesters that are not in accordance with the invention, provided that they do not affect the properties obtained for the lubricating composition.

For example, it can comprise a mixture of monoesters synthesized from a mixture of linear monocarboxylic acids comprising at least one $C_8$ to $C_{14}$ monocarboxylic acid, for example a mixture of copra fatty acids.

According to another particular embodiment, a lubricating composition according to the invention comprises less than 5% by weight, in particular less than 1% by weight, relative to the total weight of the composition, of monoester(s) not in accordance with the invention (in other words, of monoester(s) not satisfying the definition of the monoesters of the invention), and more particularly is free from monoesters not in accordance with the invention.

Preferably, a lubricating composition according to the invention comprises at least 1% by weight, particularly at least 5% by weight, in particular from 5% to 40% by weight, particularly from 10% to 30% by weight, preferably strictly greater than 10%, and more preferentially ranging from 15% to 30% by weight, of one or more monoesters according to the invention, relative to the total weight of the lubricating composition.

As mentioned above, according to a particularly preferred embodiment, a lubricating composition according to the invention for transmissions has a content of monoester(s) according to the invention of less than or equal to 30% by weight, in particular between 1% and 30% by weight and more particularly between 5% and 30% by weight.

Base Oil

As indicated above, a lubricating composition according to the invention comprises at least one base oil.

It is understood that the base oil considered according to the invention is different from the monoesters defined above.

Said base oil(s) present in a lubricating composition according to the invention is/are chosen suitably with regard to its/their compatibility with said monoester(s) used according to the invention.

This may involve a mixture of several base oils, for example a mixture of two, three or four base oils.

These base oils can be chosen from the base oils conventionally used in the field of lubricating oils, such as mineral, synthetic or natural, animal or vegetable oils or mixtures thereof.

The base oils used in the lubricating compositions according to the invention can in particular be oils of mineral or synthetic origin belonging to the groups I to V according to the classes defined in the API classification (table A), or their equivalents according to the ATIEL classification, or mixtures thereof.

TABLE 1

| | Content of saturates | Sulfur content | Viscosity Index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydroisomerized oils | ≥90% | ≤0.03% | ≥120 |
| Group IV | Polyalphaolefins (PAOs) | | |
| Group V | Esters and other bases not included in groups I to IV | | |

The mineral base oils include any type of base obtained by atmospheric and vacuum distillation of crude oil, followed by refining operations such as solvent extraction, deasphalting, solvent dewaxing, hydrotreating, hydrocracking, hydroisomerization and hydrofinishing.

The synthetic base oils can be esters of carboxylic acids and of alcohols, different from the monoesters of the invention, polyalphaolefins (PAOs) or else polyalkylene glycols (PAGs) obtained by polymerization or copolymerization of alkylene oxides comprising from 2 to 8 carbon atoms, in particular from 2 to 4 carbon atoms. The polyalphaolefins used as base oils are for example obtained from monomers comprising 4 to 32 carbon atoms, for example from decene, octene or dodecene, and the viscosity of which at 100° C. is between 1.5 and 15 $mm^2 \cdot s^{-1}$ according to the standard ASTM D445. Their average molecular weight is generally between 250 and 3000 according to the standard ASTM D5296.

Mixtures of synthetic and mineral oils can also be employed.

In general, there is no limitation as to the use of different lubricating bases for producing lubricating compositions according to the invention, except that they must have properties, in particular of viscosity, viscosity index, sulfur content, oxidation resistance, that are suitable for use for motor vehicle transmissions.

Preferably, the base oil is chosen from the oils of groups II, III and IV of the API classification, and mixtures thereof, and more preferentially from the oils of group II, the oils of group III and mixtures thereof.

In particular, a lubricating composition for transmissions according to the invention can comprise less than 30% by weight of mineral-type base oil(s), in particular less than 10% by weight, or even be completely free from mineral oil.

The kinematic viscosity, measured at 100° C. in accordance with the standard ASTM D445, of the base oil or mixture of base oils can advantageously be between 2 $mm^2/s$ and 15 $mm^2/s$, preferably between 2.5 $mm^2/s$ and 10 $mm^2$.

The kinematic viscosity, measured at 40° C. in accordance with the standard ASTM D445, of the base oil or mixture of base oils can advantageously be between 7 $mm^2/s$ and 45 $mm^2/s$, preferably between 10 $mm^2/s$ and 30 $mm^2/s$.

Advantageously, a lubricating composition according to the invention comprises at least 40% by weight of base oil(s), relative to the total weight of the composition, in particular at least 50% by weight of base oil(s), and particularly between 50% and 95% by weight and more particularly between 50% and 85% by weight of base oil(s).

Preferably, it comprises from 70% to 90% by weight of base oil(s), in particular from 70% to 85% by weight of base oil(s), relative to the total weight of the composition.

Additives

A lubricating composition according to the invention can furthermore comprise any types of additives suitable for use in a lubricant for vehicle transmissions, in particular for light or heavy vehicle transmissions.

These additives can in particular be chosen from friction-modifying additives, antiwear additives, extreme pressure additives, detergents, antioxidants, viscosity index (VI) improvers, pour point depressant additives (PPDs), dispersants, antifoam agents, thickeners, corrosion inhibitors, copper passivators, and mixtures thereof.

Advantageously, a lubricating composition according to the invention comprises one or more additives chosen from viscosity index improvers, pour point depressant additives, antiwear additives, antioxidants and mixtures thereof.

Advantageously, a lubricating composition according to the invention can comprise at least one friction-modifying additive. Friction-modifying additives make it possible to limit friction by forming monolayers adsorbed onto the surfaces of metals in contact with them. They can be chosen from compounds providing metal elements and ash-free compounds. Among the compounds providing metal elements, mention may be made of complexes of transition metals such as Mo, Sb, Sn, Fe, Cu, Zn, the ligands of which can be hydrocarbon-based compounds comprising oxygen, nitrogen, sulfur or phosphorus atoms. The ash-free friction-modifying additives are generally of organic origin and may be chosen from fatty acid esters of polyols, different from the monoester required according to the invention, alkoxylated amines, alkoxylated fatty amines, fatty epoxides, borate fatty epoxides, fatty amines or fatty acid esters of glycerol. According to the invention, the fatty compounds comprise at least one hydrocarbon-based group comprising from 10 to 24 carbon atoms. In particular, the molybdenum-based compounds may be chosen from molybdenum dithiocarbamates (Mo-DTC), molybdenum dithiophosphates (Mo-DTP), and mixtures thereof. A lubricating composition can in particular comprise a molybdenum content of between 1000 and 2500 ppm.

Advantageously, a lubricating composition according to the invention can comprise from 0.01% to 5% by weight, preferably from 0.01% to 5% by weight, more particularly from 0.1% to 2% by weight or even more particularly from 0.1% to 1.5% by weight, relative to the total weight of the lubricating composition, of friction-modifying additives.

When used at too high a content, the molybdenum compounds can negatively impact the cold properties of the lubricating composition in which they are used. Thus, a lubricating composition according to the invention preferably comprises less than 1.5% by weight of molybdenum, more preferentially less than 1% by weight, relative to the total weight of the composition, or even is free from molybdenum.

Preferably, a lubricating composition according to the invention comprises at least one antiwear additive, an extreme pressure additive or mixtures thereof. Antiwear additives and extreme pressure additives are intended to protect the friction surfaces by forming a protective film adsorbed onto these surfaces. There are a wide variety of antiwear additives. Antiwear additives chosen from polysulfide additives, sulfur-based olefin additives or phospho-sulfur-based additives, such as metal alkylthiophosphates, in particular zinc alkylthiophosphates and more specifically zinc dialkyldithiophosphates or ZnDTP, are most particularly suitable for use in the lubricating compositions according to the invention. The preferred compounds are of formula $Zn((SP(S)(OR)(OR'))_2$, in which R and R', which may be identical or different, independently represent an alkyl group, preferentially comprising from 1 to 18 carbon atoms.

Preferably, the lubricating composition according to the invention is free from phosphite-type esters containing sulfur of the formula

[Chemical formula 2]

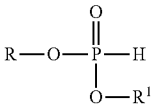

in which R is a $C_4$ to $C_{20}$ hydrocarbon-based group containing sulfur and $R^1$ is a hydrogen, a $C_4$ to $C_{20}$ hydrocarbon-based group or a $C_4$ to $C_{20}$ hydrocarbon-based group containing sulfur.

Advantageously, a lubricating composition according to the invention can comprise from 0.01% to 6% by weight, preferentially from 0.05% to 4% by weight, more preferentially from 0.1% to 2% by weight, relative to the total weight of the composition, of antiwear additives and extreme pressure additives.

Advantageously, a lubricating composition according to the invention can comprise at least one antioxidant additive. The antioxidant additive makes it possible to retard the degradation of the lubricating composition during service. This degradation may in particular be reflected by the formation of deposits, the presence of sludges, or an increase in the viscosity of the lubricating composition. They act in particular as free-radical inhibitors or hydroperoxide destroyers. Among the commonly used antioxidant additives, mention may be made of antioxidants of phenolic type, antioxidant additives of amine type and phospho-sulfur-based antioxidant additives. Some of these antioxidant additives, for example the phospho-sulfur-based antioxidant additives, may be ash generators. The phenolic antioxidant additives may be ash-free or may be in the form of neutral or basic metal salts. The antioxidant additives may in particular be chosen from sterically hindered phenols, sterically hindered phenol esters and sterically hindered phenols comprising a thioether bridge, diphenylamines, diphenylamines substituted with at least one $C_1$-$C_{12}$ alkyl group, N,N'-dialkyl-aryl-diamines, and mixtures thereof. Preferably, the sterically hindered phenols are chosen from compounds comprising a phenol group, in which at least one carbon vicinal to the carbon bearing the alcohol function is substituted with at least one $C_1$-$C_{10}$ alkyl group, preferably a $C_1$-$C_6$ alkyl group, preferably a $C_4$ alkyl group, preferably with a tert-butyl group. Amine compounds are another class of antioxidant additives that can be used, optionally in combination with the phenolic antioxidant additives. Examples of amine compounds are aromatic amines, for example the aromatic amines of formula $NR^5R^6R^7$ in which $R^5$ represents an optionally substituted aliphatic or aromatic group, $R^6$ represents an optionally substituted aromatic group, $R^7$ represents a hydrogen atom, an alkyl group, an aryl group or a group of formula $R^8S(O)_zR^9$ in which $R^8$ represents an alkylene group or an alkenylene group, $R^9$ represents an alkyl group, an alkenyl group or an aryl group and z represents 0, 1 or 2. Sulfurized alkylphenols or the alkali metal or alkaline-earth metal salts thereof may also be used as antioxidant additives.

Advantageously, a lubricating composition according to the invention can comprise from 0.1% to 2% by weight, relative to the total weight of the composition, of at least one antioxidant additive.

A lubricating composition according to the invention can also comprise at least one detergent additive. The detergent additives generally make it possible to reduce the formation of deposits on the surface of metal parts by dissolving the oxidation and combustion byproducts. The detergent additives that can be used in a lubricating composition according to the invention are generally known to those skilled in the art. The detergent additives may be anionic compounds comprising a long lipophilic hydrocarbon-based chain and a hydrophilic head. The associated cation may be a metal cation of an alkali metal or an alkaline-earth metal. The detergent additives are preferentially chosen from alkali metal or alkaline-earth metal salts of carboxylic acids, sulfonates, salicylates and naphthenates, and also phenate salts. The alkali metals and alkaline-earth metals are preferentially calcium, magnesium, sodium or barium. These metal salts generally comprise the metal in a stoichiometric amount or in excess, thus in an amount greater than the stoichiometric amount. They are then overbased detergent additives; the excess metal giving the overbased nature to the detergent additive is then generally in the form of a metal salt that is insoluble in the base oil, for example a carbonate, a hydroxide, an oxalate, an acetate or a glutamate, preferentially a carbonate.

A lubricating composition according to the invention can comprise from 0.5% to 8%, preferably from 0.5% to 4% by weight, relative to the total weight of the lubricating composition, of detergent additive.

Advantageously, a lubricating composition according to the invention can also comprise at least one pour point depressant additive (also called "PPD" agent). By slowing down the formation of paraffin crystals, the pour point depressant additives generally improve the cold-temperature behavior of the lubricating composition according to the invention. Examples of pour point reducing agents that may be mentioned include polyalkyl methacrylates, polyacrylates, polyarylamides, polyalkylphenols, polyalkylnaphthalenes and polyalkylstyrenes.

A lubricating composition according to the invention can comprise from 0.1% to 2%, preferably from 0.2% to 1% by weight, of pour point depressant additive(s), relative to the total weight of the composition.

A lubricating composition according to the invention can also comprise at least one dispersant. Such dispersants ensure the maintenance in suspension and the evacuation of the insoluble solid contaminants formed by the oxidation byproducts which form when the lubricating composition is in use. They can be chosen from Mannich bases, succinimides and derivatives thereof, such as polyisobutylene succinic anhydride derivatives.

In particular, a lubricating composition according to the invention can comprise from 0.2% to 10% by weight of dispersant(s), relative to the total weight of the composition.

A lubricating composition according to the invention can also comprise at least one viscosity index (VI) improving additive. Viscosity index improvers, in particular polymers which improve the viscosity index, make it possible to guarantee good resistance to cold and a minimal viscosity at high temperature. As examples of polymers which improve the viscosity index, mention may be made of polymeric esters, hydrogenated or non-hydrogenated homopolymers or copolymers of styrene, of butadiene and of isoprene, homopolymers or copolymers of olefins, such as ethylene or propylene, polyacrylates and polymethacrylates (PMA), preferably homopolymers or copolymers of olefins, such as ethylene or propylene.

In particular, a lubricating composition according to the invention can comprise from 1% to 15% by weight of viscosity index-improving additive(s), preferably from 5% to 10% by weight, relative to the total weight of the lubricating composition.

A lubricating composition can also comprise at least one antifoam additive, for example chosen from polar polymers such as polymethylsiloxanes or polyacrylates. In particular, a lubricating composition according to the invention can comprise from 0.01% to 3% by weight of antifoam additive(s), relative to the total weight of the lubricating composition. It may also comprise at least one anticorrosion agent or copper passivator, for example compounds such as polyisobutene succinic anhydrides, thiadiazole sulfonates or mercaptobenzothiazoles. They are typically present in a lubricating composition according to the invention at contents of between 0.01% and 1% by weight, relative to the total weight of the composition.

Advantageously, a lubricating composition according to the invention comprises one or more additives chosen from viscosity index improvers, pour point depressants, antiwear agents and antioxidants.

According to a particular embodiment, a lubricating composition according to the invention comprises, or even consists of:

- at least 5% by weight, preferably from 10% to 40%, more preferentially 15% to 30% by weight, of one or more monoesters according to the invention and as defined above, preferably 2-ethylhexyl dodecanoate;
- from 50% to 85% by weight of base oil(s) different from the monoesters defined according to the invention, preferably chosen from the base oils of group II and/or III according to the API classification;
- optionally from 5% to 15% by weight of at least one viscosity index-improving additive;
- optionally from 0.1% to 1% by weight of at least one pour point depressant additive;
- optionally from 0.01% to 6% by weight of at least one antiwear additive; and
- optionally from 0.1% to 2% by weight of at least one antioxidant additive, the contents being expressed relative to the total weight of said composition.

Preferably, a lubricating composition according to the invention for motor vehicle transmissions comprises, or even consists of:

- less than 30% by weight, in particular from 1% to 30% by weight, particularly from 5% to 30% by weight, preferably from 10% to 30% by weight, and more particularly from 15% to 30% by weight, of one or more monoesters according to the invention and as defined above, preferably 2-ethylhexyl dodecanoate;
- from 50% to 85% by weight of base oil(s) different from the monoesters defined according to the invention, preferably chosen from the base oils of group II and/or III according to the API classification;
- optionally from 5% to 15% by weight of at least one viscosity index-improving additive;
- optionally from 0.1% to 1% by weight of at least one pour point depressant additive;
- optionally from 0.01% to 6% by weight of at least one antiwear additive; and
- optionally from 0.1% to 2% by weight of at least one antioxidant additive, the contents being expressed relative to the total weight of said composition.

A lubricating composition according to the invention advantageously has a kinematic viscosity, measured at 40° C. in accordance with the standard ASTM D445, of between 20 $mm^2/s$ and 50 $mm^2/s$, preferably of between 25 $mm^2/s$ and 40 $mm^2/s$.

More advantageously, a lubricating composition according to the invention has a kinematic viscosity, measured at 100° C. in accordance with the standard ASTM D445, of between 2 $mm^2/s$ and 20 $mm^2/s$, preferably of between 4 $mm^2/s$ and 15 $mm^2/s$.

Advantageously, a lubricating composition according to the invention has a viscosity index of between 100 and 300, preferably of between 150 and 250.

As mentioned above, a lubricating composition according to the invention has good performance qualities in terms of cold properties.

The Brookfield viscosity at low temperature of a lubricating composition quantifies its ability to remain liquid at very low temperatures and in particular is representative of its ability to retain its properties in cold conditions.

Preferably, a lubricating composition according to the invention has a Brookfield viscosity, measured at −40° C. in accordance with the standard ASTM D2983, of between 1000 mPa·s and 100,000 mPa·s, preferably of between 5000 mPa·s and 60,000 mPa·s.

Also, as mentioned above, a lubricating composition according to the invention has excellent properties in terms of reducing fuel consumption (fuel economy properties).

Advantageously, a lubricating composition according to the invention thus has low coefficients of traction. The coefficient of traction is determined by an MTM machine (Mini Traction Machine) sold by PCS instrument. It can be evaluated, as described in the examples, according to the following operating conditions: temperature of 40° C., load of 75 N, disk speed of 1 m/s for an SRR (sliding-rolling ratio) of 20%.

As illustrated in the examples which follow, the use of a monoester according to the invention makes it possible to reduce the coefficient of traction by at least 5%, advantageously by at least 10%, or even by at least 15%.

A lubricating composition of the invention is suitable for lubricating the transmission components of motor vehicles, in particular transmission components for light or heavy vehicles, for example gearboxes and/or axles.

In particular, it can be used to lubricate the manual gearbox and/or the axles of a light or heavy vehicle. Advantageously, a lubricating composition according to the invention has performance qualities, in particular in terms of cold properties, that are particularly well suited to the use thereof for heavy-duty vehicle transmissions, in particular for lubricating a manual gearbox and/or heavy-duty axles.

The invention will now be described by means of the following examples, given by way of illustration and without limiting the invention.

EXAMPLE

Description of the Monoesters According to the Invention that are Used in the Examples

TABLE 2

| Compositions | KV100 ASTM D445 ($mm^2/s$) | Pour point (° C.) ISO 3106 |
|---|---|---|
| ME1 | 1.80 | −33 |
| ME2 | 1.93 | 0 |
| ME3 | 2.16 | −33 |

ME1: monoester of linear $C_{12}$ acid and 2-ethylhexanol.

ME2: monoester of copra fatty acid(*) and 2-ethylhexanol.

ME3: monoester of linear $C_{12}$ acid and 3,5,5-trimethylhexanol.

(*) Copra acid: mixture of linear fatty acids comprising between 8 and 18 carbon atoms, and predominantly comprising dodecanoic acid ($C_{12}$) and tetradecanoic acid ($C_{14}$).

Preparation of the Compositions

Six lubricating compositions, CL1, CL2, CL3, CL4, CL5 and CL6, were formulated with the monoesters in accordance with the invention. These compositions were prepared by simple mixing, at ambient temperature, of the following components in the proportions by weight indicated in table 3 below.

The reference composition is a lubricating composition for transmission which does not comprise a monoester according to the invention.

TABLE 3

| Compositions | Ref | CL1 | CL2 | CL3 | CL4 | CL5 | CL6 |
|---|---|---|---|---|---|---|---|
| Base oil (mixture of a base oil of group II and a base oil of group III) | 82.2 | 49.5 | 59.5 | 49.5 | 59.5 | 50 | 60 |
| Viscosity index improver (ethylene-propylene copolymer) | 7.6 | 10 | 10 | 10 | 10 | 9.5 | 9.5 |
| Additive package(1) | 10 | 10 | 10 | 10 | 10 | 10 | 10 |
| Pour point depressant (acrylic polymer) | 0.2 | 0.5 | 0.5 | 0.5 | 0.5 | 0.5 | 0.5 |
| ME1 | — | 30 | 20 | — | — | — | — |
| ME2 | — | — | — | 30 | 20 | — | — |
| ME3 | — | — | — | — | — | 30 | 20 |

(1)comprising an antiwear agent, an extreme pressure agent, a dispersant, a detergent, an antifoam agent, an antioxidant and a friction modifier.

Measurement of the Rheological Properties of the Compositions—Cold Properties

The kinematic viscosities at 40° C. and at 100° C. (KV40 and KV100) of the compositions prepared above were measured in accordance with the standard ASTM D445.

The viscosity index of the compositions is calculated from the kinematic viscosities at 40° C. and at 100° C. measured for each of the lubricating compositions.

The cold properties are evaluated by measuring the Brookfield viscosity at −40° C. in accordance with the standard ASTM D2983.

The results are collated in table 4 below.

TABLE 4

| Compositions | Ref. | CL1 | CL2 | CL3 | CL4 | CL5 | CL6 |
|---|---|---|---|---|---|---|---|
| KV40 ($mm^2/s$) | 31.10 | 27.55 | 30.76 | 28.23 | 31.50 | 28.77 | 31.18 |
| KV100 ($mm^2/s$) | 6.46 | 6.38 | 6.80 | 6.50 | 6.92 | 6.56 | 6.84 |
| Viscosity index | 168 | 196 | 189 | 196 | 190 | 194 | 188 |
| Brookfield −40° C. (mPa · s) | 11400 | 14000 | 8800 | 14100 | 7600 | 44600 | 17500 |

These results show that the compositions according to the invention have a good Brookfield viscosity, like the reference composition. The compositions of the invention thus have particularly satisfactory cold performance qualities for use in the lubrication of transmission components of light and heavy-duty vehicles.

Evaluation of the Coefficient of Traction of the Compositions

The coefficient of traction (COT) was measured using an MTM tribometer from PCS instrument. It allows the performance qualities of lubricants to be evaluated in terms of friction in a mixed/hydrodynamic regime. This test consists in setting a steel ball and a steel plate in relative motion at different speeds, making it possible to define the % SSR (ratio of sliding speed/entrainment speed or Slide-to-Roll Ratio) which corresponds to the sliding speed/entrainment speed.

The measurement conditions were 75 N load, a disk speed of 1 m/s for an evaluated temperature of 40° C. and an SRR of 20%.

The lower the coefficient of traction for a lubricating composition, the more the friction between the metal parts is reduced, thus resulting in a greater gain in terms of fuel economy. The results obtained are presented in table 5 below.

TABLE 5

| Compositions | Ref. | CL1 | CL3 | CL5 |
|---|---|---|---|---|
| COT (40 C.; 20% SRR) | 0.0482 | 0.0389 | 0.0390 | 0.0414 |
| % reduction in COT compared to the ref. composition | — | −19% | −19% | −14% |

The lubricating compositions according to the invention, CL1, CL3 and CL5, have a reduced coefficient of traction compared to the reference composition not using a monoester according to the invention.

It can therefore be deduced from this that the compositions according to the invention will have improved performance in terms of fuel economy.

The invention claimed is:

1. A method for reducing the fuel consumption of a vehicle equipped with a transmission component, the method comprising lubricating the transmission component using a lubricating composition comprising:

a base oil; and a monoester that is different from the base oil and that is formed by reacting a linear, saturated $C_{10}$-$C_{12}$ monocarboxylic acid with a branched, saturated $C_7$-$C_{10}$ monoalcohol, wherein:

the lubricating composition comprises 30% by weight or less of the monoester, relative to the total weight of the lubricating composition; and the kinematic viscosity of a total amount of base oil included in the lubricating composition, measured at 100° C. in accordance with the standard ASTM D445, ranges from 2 $mm^2/s$ to 15 $mm^2/s$.

2. The method of claim 1, wherein the monoester has a kinematic viscosity, measured at 100° C. in accordance with the standard ASTM D445, ranging from 1.0 $mm^2/s$ to 2.5 $mm^2/s$.

3. The method of claim 1, wherein the monoester has a pour point, measured in accordance with the standard ISO 3106, of less than or equal to 0° C.

4. The method of claim 1, wherein the linear, saturated $C_{10}$-$C_{12}$ monocarboxylic acid comprises a linear saturated $C_{12}$ monocarboxylic acid.

5. The method of claim 1, wherein the branched, saturated $C_7$-$C_{10}$ monoalcohol comprises a branched monoalcohol comprising a linear main alkyl chain having from 7 to 9 carbon atoms, the main chain having at least one pendant alkyl group.

6. The method of claim 1, wherein the monoester comprises 2-ethylhexyl dodecanoate.

7. The method of claim 1, wherein the base oil comprises at least one oil chosen from Groups I, II, III, or IV of the API classification.

8. The method of claim 1, wherein the lubricating composition comprises at least 40% by weight of the base oil, relative to the total weight of the lubricating composition.

9. The method of claim 1, wherein the lubricating composition further comprises at least one additive chosen from friction-modifying additives, anti-wear additives, extreme pressure additives, detergents, antioxidants, viscosity index (VI) improvers, pour point depressant additives (PPDs), dispersants, antifoam agents, thickeners, corrosion inhibitors, copper passivators, or mixtures thereof.

10. The method of claim 1, wherein the lubricating composition comprises, based on the total weight of the lubricating composition:

less than 30% by weight of the monoester;

from 50% to 85% by weight of the base oil;

optionally from 5% to 15% by weight of at least one viscosity index-improving additive;

optionally from 0.1% to 1% by weight of at least one pour point depressant additive;

optionally from 0.01% to 6% by weight of at least one anti-wear additive; and optionally from 0.1% to 2% by weight of at least one antioxidant.

11. The method of claim 1, wherein the transmission component is a gearbox and/or an axle.

12. The method of claim 1, wherein the linear, saturated $C_{10}$-$C_{12}$ monocarboxylic acid comprises a linear, saturated $C_{11}$-$C_{12}$ monocarboxylic acid.

13. The method of claim 1, wherein the lubricating composition comprises from 5% to 30% by weight of the monoester, relative to the total weight of the lubricating composition.

14. The method of claim 1, wherein the lubricating composition comprises from 15% to 25% by weight of the monoester, relative to the total weight of the lubricating composition.

15. The method of claim 1, wherein the base oil comprises at least one oil chosen from Group II of the API classification, at least one oil chosen from Group III of the API classification, or a combination of oils chosen from Group II and Group III.

16. The method of claim 1, wherein the lubricating composition comprises between 70% and 85% by weight of the base oil, relative to the total weight of the lubricating composition.

* * * * *